US008430524B2

(12) United States Patent
Chen et al.

(10) Patent No.: US 8,430,524 B2
(45) Date of Patent: Apr. 30, 2013

(54) LED LAMP

(75) Inventors: Chin-Chung Chen, Taipei Hsien (TW); Hai-Wei Zhang, Shenzhen (CN); Ci-Jin Mo, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 784 days.

(21) Appl. No.: 12/540,353

(22) Filed: Aug. 12, 2009

(65) Prior Publication Data

US 2011/0002116 A1 Jan. 6, 2011

(30) Foreign Application Priority Data

Jul. 1, 2009 (CN) ..... 2009 1 0303908

(51) Int. Cl.
*F21V 21/00* (2006.01)

(52) U.S. Cl.
USPC .. 362/240; 362/249.02; 362/235; 362/296.05

(58) Field of Classification Search ..... 362/240, 362/235, 296.05, 345, 347
See application file for complete search history.

(56) References Cited

U.S. PATENT DOCUMENTS

| | | | | |
|---|---|---|---|---|
| 1,852,840 | A * | 4/1932 | Fuwa et al. | 65/120 |
| 6,183,100 | B1 | 2/2001 | Suckow et al. | |
| 7,568,817 | B2 * | 8/2009 | Lee et al. | 362/294 |
| 7,568,821 | B2 * | 8/2009 | Peck et al. | 362/341 |
| 8,033,683 | B2 * | 10/2011 | Fields | 362/231 |
| 2007/0274070 | A1 * | 11/2007 | Wedell | 362/244 |
| 2008/0049438 | A1 | 2/2008 | Bloemen et al. | |

* cited by examiner

*Primary Examiner* — Sharon Payne
(74) *Attorney, Agent, or Firm* — Altis Law Group, Inc.

(57) ABSTRACT

An LED lamp includes a base, a first LED module attached to a bottom surface of the base, a second LED module attached to a top surface of the base, and a reflector engaged on the top surface of the base. The reflector has an outer surface facing and angled with the second LED module. Light generated by the first LED module radiates to a bottom side of the LED lamp, and light generated by the second LED module is reflected by the outer surface of the reflector to radiate out and toward a lateral side of the LED lamp.

12 Claims, 4 Drawing Sheets

LED LAMP

BACKGROUND

1. Technical Field

The disclosure relates to an LED lamp and, more particularly, to an LED lamp providing a wide illumination area.

2. Description of Related Art

The technology of light emitting diodes has been rapidly developed in recent years, allowing expansion of application from indicators to include illumination. With the features of long-term reliability, environment friendliness and low power consumption, the LED is viewed as a promising alternative for recent lighting products.

A conventional LED lamp comprises a heat sink and a plurality of LED modules having LEDs, attached to an outer surface of the heat sink to dissipate heat generated by the LEDs. The outer surface of the heat sink is generally planar with the LEDs arranged closely. However, such LEDs mounting on the planar outer surface of the heat sink provides only a planar light source, and just provides a narrow illumination area.

What is needed, therefore, is an LED lamp providing a sufficiently wide illumination area to function as a three-dimensional light source.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
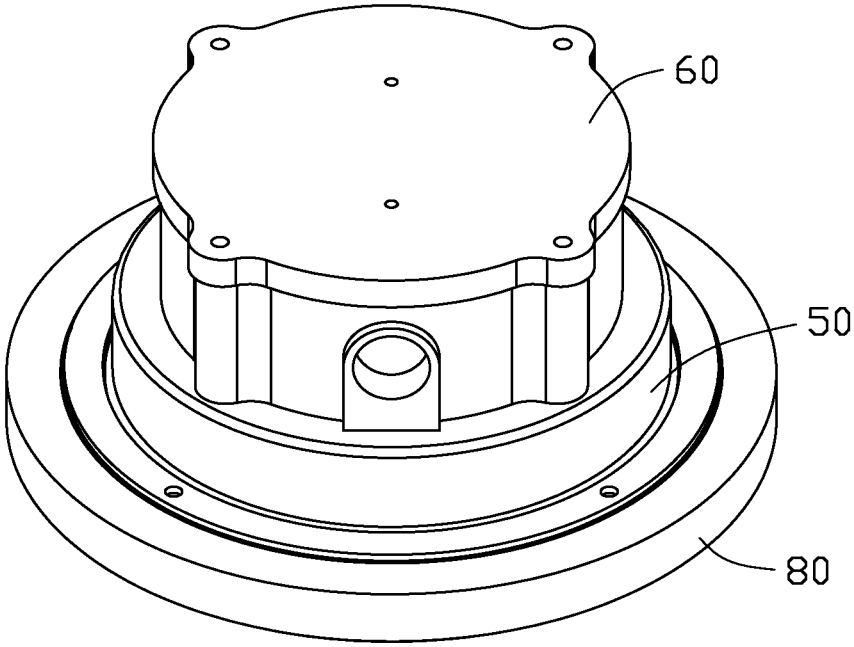
FIG. 1 is an isometric, assembled view of an LED lamp in accordance with an embodiment of the disclosure.
Figure 2:
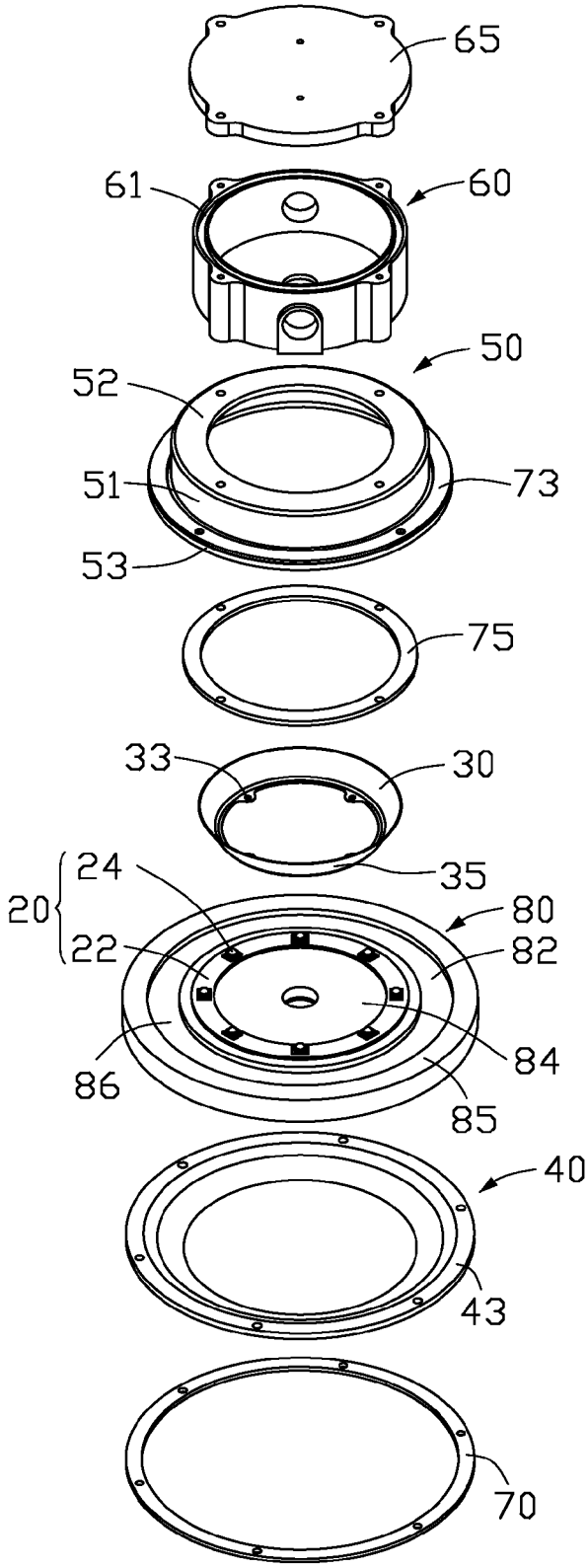
FIG. 2 is an exploded view of the LED lamp of FIG. 1.
Figure 3:
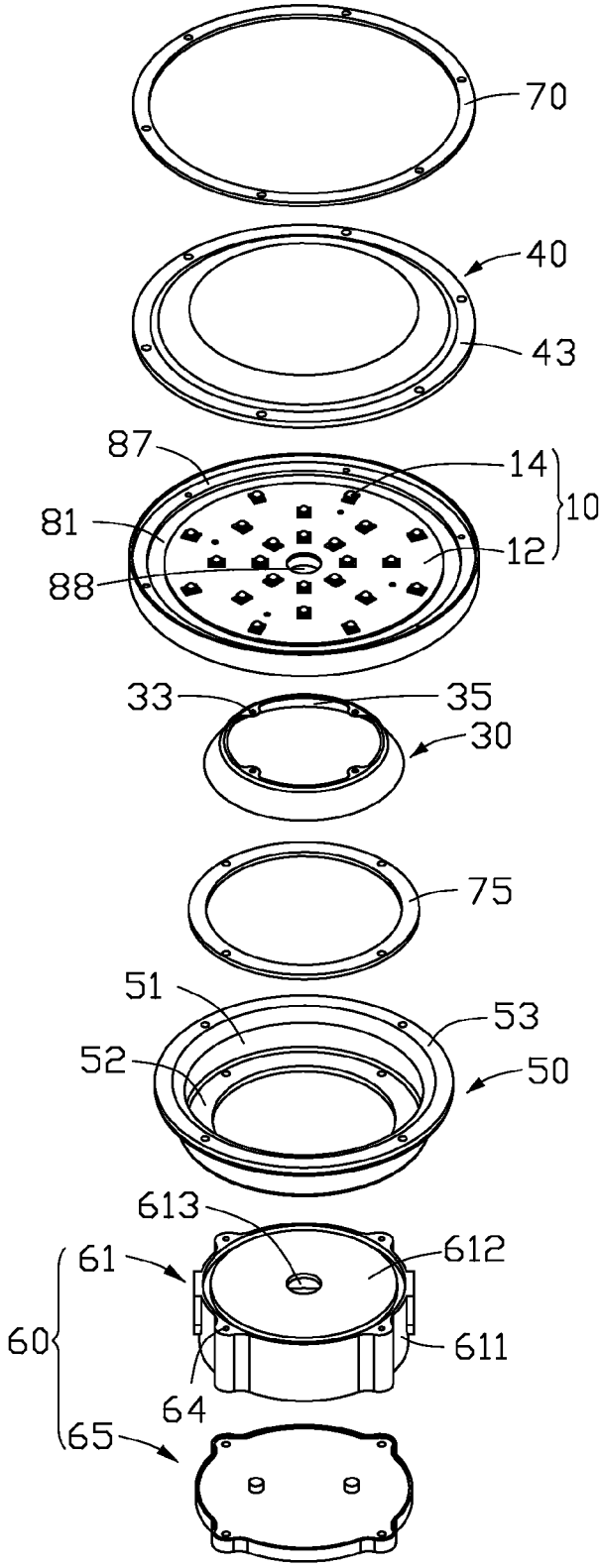
FIG. 3 is an inverted view of the LED lamp of FIG. 2.

Referring to FIGS. 1-3, an LED lamp in accordance with the disclosure is illustrated. The LED lamp comprises a heat sink, which in this embodiment, is a disk-shaped base 80, a first LED module 10 located under the base 80, a second LED module 20 and a reflector 30 mounted on the base 80. The first LED module 10 thermally contacts a bottom surface 81 of the base 80. The second LED module 20 thermally contacts a top surface 82 of the base 80, surrounding the reflector 30 and facing to the reflector 30. The LED lamp further comprises a first envelope 40 engaging with the bottom surface 81 of the base 80 to enclose the first LED module 10 therein, a second envelope 50 engaging the top surface 82 of the base 80 to enclose the second LED module 20 therein, and a lamp set 60 mounted on and engaging with the second envelope 50.

The base 80 is integrally formed of a metal with good heat conductivity such as aluminum, copper or an alloy thereof. The base 80 has a disk-shaped projection 84 extending upwardly from a center of the top surface 82 thereof and an annular flange 85 extending upwardly from an edge of the top surface 82 thereof. The projection 84 and the flange 85 cooperatively define an annular groove 86 therebetween at the top surface 82 of the base 80. The base 80 downwardly extends a step-shaped flange 87 from an edge of the bottom surface 81 thereof. The base 80 defines a central hole 88 extending through the top and bottom surfaces 81, 82. Alternatively, the base 80 may have other shape, such as an elliptical shape, or a square shape. In other embodiment, the base 80 can have a plurality of fins for dissipating heat from the first LED module 10 and the second LED module 20 more quickly.

The first LED module 10 comprises a circular printed circuit board 12 and a plurality of LEDs 14 mounted on the printed circuit board 12. The second LED module 20 includes an annular printed circuit board 22 and a plurality of LEDs 24 evenly mounted on the printed circuit board 22 in a circular array. The second LED module 20 is mounted on the projection 84 of the base 80 and near an outer edge of the projection 84.

The reflector 30 is mounted on the projection 84 of the base 80 and surrounded by the LEDs 24 of the second LED module 20. The reflector 30 is configured as an inverted hollow conical frustum. A diameter of a bottom of the reflector 30 is smaller than that of a top thereof, and smaller than an inner diameter of the printed circuit board 22 of the second LED module 20. The reflector 30 evenly extends a plurality of tabs 33 inwardly from the bottom edge thereof. The tabs 33 are provided for securing the reflector 30 on the projection 84 of the base 80. The reflector 30 has an outer surface 35, which is angled in respect to the second LED module 20. The outer surface 35 defines an acute angle with respect to the top surface 82 of the base 80. The outer surface 35 of the reflector is curved from the bottom to the top of the reflector 30, and can be spherical, elliptical or parabolic face.

The first envelope 40 is substantially bowl-shaped and made of transparent or semitransparent material such as glass or plastic. The first envelope 40 has an annular flange 43 extending outwards from a top edge thereof. The outer flange 43 of the first envelope 40 has a configuration identical to that of the step-shaped flange 87 of the base 80, whereby the flange 43 is fittingly received on the step-shaped flange 87 of the base 80. The first envelope 40 is used to transmit light emitted by the first LED module 10 and prevent foreign articles from entering into the lamp and contaminating the first LED module 10. A first retaining ring 70 is mounted on the flange 43 of the first envelope 40 by extending six screws (not shown) through the first retaining ring 70 and the flange 43 of the first envelope 40 to engage in the base 80. The first retaining ring 70 is made of metal sheet and has a configuration identical to that of the flange 43 of the first envelope 40.

The second envelope 50 is cylindrical shaped and made of transparent or semitransparent material such as glass or plastic. The second envelope 50 includes a vertical sidewall 51, an inner flange 52 inwardly extending from a top edge of the sidewall 51, and an outer flange 53 outwardly and perpendicularly extending from a bottom edge of the sidewall 51. The inner flange 52 and the outer flange 53 each are annular. The outer flange 53 is fittingly received within the groove 86 at the top surface 82 of the base 80. A second retaining ring 73 is mounted on the outer flange 53 of the second envelope 50. The second retaining ring 73 is made of metal sheet and has a configuration identical to that of the outer flange 53 of the second envelope 50. Four screws (not shown) extend through the second retaining ring 73 and the outer flange 53 and engage in the base 80 to secure the second envelope 50 on the top surface 82 of the base 80. A third retaining ring 75 is located under the inner flange 52 for engaging with the lamp set 60 on the inner flange 52. The first and second envelopes 40, 50 can be transparent or frosted, depending on the requirement.

The lamp set 60 comprises a hollow cylindrical holder 61 and a cover 65 mounted on the holder 61. The holder 61 has a bottom plate 612 mounted on the inner flange 52 of the second envelope 50 and a cylindrical sidewall 611 extending upwardly form edge of the bottom plate 612. The bottom plate 612 defines a central hole 613 corresponding to the central hole 88 of the base 80 for extension of electrical wires (not shown) therethrough to be in electrical connection with the first LED module 10 and the second LED module 20. The holder 61 is used for receiving a driving circuit module (not shown) therein.

Figure 4:
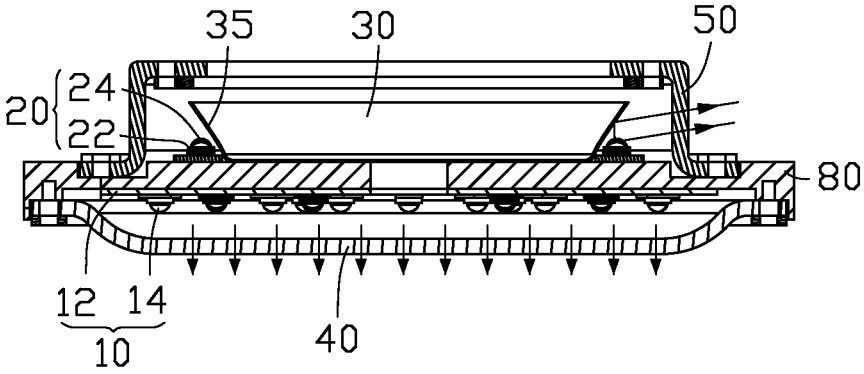
FIG. 4 is a cross sectional view of the LED lamp of FIG. 1, in which a lamp set of the LED lamp is removed for clarity.

Referring to FIG. 4, in use, light generated by the first LED module 10 is directly transmitted through the first envelope 40 and projects outwardly towards to the bottom of the LED lamp, as indicated by the downwardly pointing arrows. Light generated by the second LED module 20 is reflected by outer surface 35 of the reflector 30 and then through the annular sidewall 51 of the second envelope 50 towards lateral sides of the LED lamp, as indicated by the laterally pointing arrows. Thus, the first second LED modules 10, 20 of the LED lamp can generate light that can radiate toward multiple directions, i.e., along the downward direction and the lateral direction, toward the exterior of the lamp. Thus, the LED lamp in accordance with present disclosure can have a large illumination area. Illumination angle of the LED lamp in accordance with the present disclosure is over 180 degrees. In this embodiment, the illumination angle of the LED lamp is 240 degrees.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED (light emitting diode) lamp, comprising:

a base having a top surface and a bottom surface opposite to the top surface;

a first LED module attached to the bottom surface of the base;

a second LED module attached to the top surface of the base;

a reflector engaged on the top surface of the base, having an outer surface facing and angled with the second LED module;

a first envelope engaging on the bottom surface of the heat sink and receiving the first LED module; and a second envelope mounted on the top surface of the base and receiving the second LED module and the reflector, the second envelope having an annular sidewall to transmit the light generated by the second LED module, and a flange perpendicularly extending from a bottom edge of the sidewall;

wherein light generated by the first LED module radiates to a bottom side of the LED lamp, and light generated by the second LED module is reflected by the outer surface of the reflector to radiate out and toward a lateral side of the LED lamp; and wherein the base has a disk-shaped projection extending from a center and an annular flange extending from an edge of the top surface, the projection and the flange cooperatively define an annular groove to receive the flange of the second envelope.

2. The LED lamp as claimed in claim 1, wherein the reflector is surrounded by the second LED module.

3. The LED lamp as claimed in claim 2, wherein the reflector is configured as an inverted hollow conical frustum.

4. The LED lamp as claimed in claim 3, wherein the second LED module comprises an annular printed circuit board a plurality of LEDs evenly mounted on the printed circuit board in a circular array.

5. The LED lamp as claimed in claim 3, wherein the reflector evenly extends a plurality of tabs inwardly from a bottom edge thereof for securing on the base.

6. The LED lamp as claimed in claim 1, wherein the second envelope is frosted.

7. The LED lamp as claimed in claim 1, wherein the disk-shaped projection is extending upwardly from the center of the base, and the annular flange is extending upwardly from the edge of the top surface of the base.

8. The LED lamp as claimed in claim 7, wherein an upper surface of the disk-shaped projection is at a same height with an upper surface of the annular flange of the base.

9. An LED lamp, comprising:

a heat sink having a top surface and a bottom surface opposite to the top surface;

first and second LED modules attached to heat sink; and a reflector engaged on the heat sink and having an outer surface;

a first envelope engaging on the bottom surface of the heat sink and receiving the first LED module; and a second envelope engaging on the top surface of the heat sink and receiving the second LED module and the reflector, the second envelope having an annular sidewall to transmit the light generated by the second LED module, and a flange perpendicularly extending from a bottom edge of the sidewall;

wherein light generated by the first LED module radiates outwardly along an downward direction of the LED lamp, and light generated by the second LED module is reflected by the outer surface of the reflector to radiate outwardly along a lateral direction of the LED lamp;

wherein the heat sink has a disk-shaped projection extending from a center and an annular flange extending from an edge of the top surface, the projection and the flange cooperatively define an annular groove to receive the flange of the second envelope.

10. The LED lamp as claimed in claim 9, wherein the reflector is configured as an inverted hollow conical frustum, and the outer surface of the reflector is curved.

11. The LED lamp as claimed in claim 9, wherein the reflector evenly extends a plurality of tabs inwardly from a bottom edge thereof for securing on the heat sink.

12. The LED lamp as claimed in claim 9, wherein the reflector is surrounded by the second LED module.

* * * * *